United States Patent [19]

Buchanan

[11] 4,055,460

[45] Oct. 25, 1977

[54] PAPER MACHINE SHAKE

[75] Inventor: John Gordon Buchanan, Pointe Claire, Canada

[73] Assignee: JWI Ltd., Montreal, Canada

[21] Appl. No.: 753,791

[22] Filed: Dec. 23, 1976

Related U.S. Application Data

[63] Continuation of Ser. No. 667,947, March 18, 1976, abandoned, which is a continuation of Ser. No. 495,777, Aug. 8, 1974, abandoned.

[51] Int. Cl.[2] ..... D21F 1/20

[52] U.S. Cl. ..... 162/209; 162/352; 162/355; 162/374

[58] Field of Search ..... 162/209, 352, 355, 356, 162/374, 199, 272

[56] References Cited

U.S. PATENT DOCUMENTS

| | | | |
|---|---|---|---|
| 1,839,158 | 12/1931 | McDonnell | 162/355 X |
| 1,917,098 | 7/1933 | Cofrin | 162/209 |
| 2,076,991 | 4/1937 | Holgersson et al. | 162/209 X |
| 3,220,920 | 11/1965 | Truxa | 162/352 |
| 3,232,828 | 2/1966 | Ouellet | 162/209 X |
| 3,337,394 | 8/1967 | White et al. | 162/352 |
| 3,432,385 | 3/1969 | Thorp | 162/352 |

*Primary Examiner*—S. Leon Bashore
*Assistant Examiner*—Marc L. Caroff
*Attorney, Agent, or Firm*—Alan Swabey & Co.

[57] ABSTRACT

The invention is to shake the upper run of a Fourdrinier forming fabric of a paper machine by imparting vibratory motion, in a direction transverse to the machine direction, to light-weight foil blades mounted at the dilute end of the Fourdrinier section. The foils, which are in contact with the fabric, cause the upper run to vibrate in the same transverse direction, thereby shaking the stock and improving paper formation. It is preferred to vibrate the foils at a frequency close to the resonant natural frequency of the upper run of a fabric or a harmonic thereof. All or part of the top surface of some of the foils, which contact the upper run of the forming fabric, may be coated with a material having a relatively high coefficient of friction to increase the frictional contact between the upper surface of the foil and the forming fabric.

19 Claims, 3 Drawing Figures

12
13
11
10
9
9
9
21
27
5
24
A
B
C
A
B
C
7
7
7
8
8
8
2

PAPER MACHINE SHAKE

This is a continuation of application Ser. No. 667,947, filed Mar. 18, 1976; which is a continuation of application Ser. No. 495,777, filed Aug. 8, 1974, both now abandoned.

BACKGROUND OF THE INVENTION

1. Field of the Invention

This invention relates to a method and apparatus to improve the quality of paper made on a Fourdrinier paper making apparatus.

More specifically, the invention relates to apparatus for "shaking" the forming fabric of a paper making machine, that is, providing cross machine motion to the fabric in the wet forming section or wet end of the machine as it is commonly known.

2. Description of the Prior Art

On Fourdrinier type paper making machines, stock, made up of fibers and fillers in an aqueous solution containing generally about 99.5% water, is fed onto an endless moving Fourdrinier forming screen and water is drained from the stock through the screen by means of dewatering devices consisting of foils, table rolls and suction boxes, leaving the fibers in a mat or web form on top of the screen. The fibrous mat is then peeled from the forming screen continuously and transferred to other parts of the paper machine where it is pressed and dried.

In spite of attempts to thoroughly mix the stock before it is deposited on the forming screen, the fibres of the stock invariably tend to agglomerate in the head box and become deposited on the screen in clumps or flocs so that the paper will not be of uniform density and, even if the stock is deflocculated in the head box, it will, if not distributed, reflocculate in a short time while being formed. Also, there is a tendency for stock fibres to become aligned in the machine direction which is detrimental to cross machine strength of the paper.

In early designs of the Fourdrinier machine a "shake" was utilized to agitate the stock at the wet end on the endless screen to continuously deflocculate the fibres of the stock to improve the formation of the paper. Formation, relating to paper making, is defined in "The Dictionary of Paper" — published under the Auspices and direction of the American Paper an Pulp Association, New York, 1940, George Banta Publishing Company, Menasha, Wis., as a property which is determined by the degree of uniformity of distribution of the solid components of the sheet with special reference to the fibers. It is usually judged by the visual appearance of the sheet when viewed by transmitted light. Formation is very important, not only because of its influence on the appearance of the paper, but because it influences nearly all other properties. The "shake" is a transverse oscillation of the wet end of the Fourdinier section in the plane of the screen and at right angles to the direction of its travel. Thus, the stock and fabric, in addition to moving in the longitudinal direction, are subjected to a small transverse oscillatory motion as they travel down the machine.

Since the stock is fluid, a shearing motion is set up between the stock and the screen which helps to break up flocs and aids in paper formation. In its original form, the "shake" motion was imparted to the wet end of the forming screen by shaking the breast roll and the table rolls with their mounting frames and bearings. As Fourdrinier machines were made larger, it became increasingly difficult to shake the whole wet end in this manner because of the increased mass of the machine. In addition, as the speed of the machines increased, there was a corresponding need to increase the frequency of the shake. The increased mass, coupled with the need to increase the frequency of shake with speed, caused the required shaking force to become very high and practically impossible to achieve. In practice, most papermakers do not attempt to shake the stock when speeds over 1000 fpm are reached. As a result, paper made at speed over 1000 fpm suffers in formation somewhat compared with paper made at lower speeds with the help of shake.

As Fourdrinier paper machine were speeded up beyond 1000 fpm, the action of the "shake" was provided to some extent by a vertical vibration of the screen which is caused by a sucking action of the table rolls and foils acting on the flexible screen. These suction forces increased rapidly with speed and the vertical deflection of the screen in the down-stream nips of the table rolls or foils become large enough to agitate the stock. This type of agitation is well described in the Canadian patent of Wrist, 586,545, as "stock kick-up" as well as in many other places in paper-making literature.

In the present state of the art, a modern Fourdrinier machine contains mostly foils in the forming section of the machine and these foils are designed so as to achieve the best combination of drainage, retention and stock kick-up so as to produce the best quality of paper. Factors such as the foil angle, the length of the foil surface in the machine direction and the spacing between adjacent foils are critical in achieving the optimum result. When properly adjusted and designed, fairly good quality paper can be made and, for this reason, the need for a shake on high speed machines is overcome to some extent. However, the proper adjustment of a foil table requires great skill and inevitably some compromise must be made. Also, if the quality of the stock changes or the machine is speeded up, a different table configuration is theoretically required for optimization.

One attempt to overcome the problem of having to shake a large mass of machinery was to provide special table rolls which could move axially through their bearings at the ends. In this way, only the smaller mass of the breast roll and the shells of the table rolls need be shaken. (Pulp and Paper Manufacture Vo. 3 (1953) pp 142 Fourdrinier Shakes — J. Newell Stephenson). This method never came into wide-spread use because of mechanical difficulties.

In a further attempt to overcome the problem of having to shake a large mass, U.S. Pat. No. 1,839,158, McDonnell, teaches a method of shaking only the breast roll and selected table rolls or only selected table rolls in an attempt to localize the shake in a critical area. However, even the selected table rolls have a mass of the order of hundreds of pounds, and the inertia presented by so large a mass prevents the rolls from being shaken at a high enough frequency as required for high speed machines. In addition, because of the cylindrical shape of the roll, only a very small surface of the roll is in contact with the upper run of the Fourdrinier screen so that the frictional engagement between the roll and the screen is not very good. To present a larger area of contact, McDonnell proposes an upward slope of the Fourdrinier screen in the area of a single movable table roll. Because of these problems, the method and apparatus proposed in the U.S. Pat. No. 1,839,158 has never come into wide-spread use.

The prior art has also taught electric vibrators oscillating the Fourdrinier screens in a vertical plane (U.S. Pat. No. 1,841,702 — E. E. Berry). This method has no great advantage over the present state of the art where vertical vibrations are caused by foils or table rolls. None of the previous attempts have come into widespread use for speeds over 1000 fpm, thus leaving a wide range of speeds without an effective means of stock oscillation or shaking. Most modern paper making machines are operated at speeds in excess of 1000 fpm and many are operated in the range of 2,000 – 3,000 fpm.

SUMMARY OF THE INVENTION

The invention provides a solution to these problems by using movable foil means, which may be a single movable foil or a plurality of such foils, to shake the upper run of the forming screen. The movable foil means is moved back and forth, in a vibratory motion, in sliding frictional contact with the screen, at right angles to the direction of its run. Frictional contact between the foil surface and the screen combined with the suction created by the foil causes transverse vibration of the upper run effectively shaking the stock carried by it.

More specifically, an apparatus according to the invention includes an endless screen belt of synthetic forming fabric to carry paper-making stock, driven in the machine direction by a drive roll and including an upper run and a lower run between a drive roll and a driven roll. Foil means are disposed between the upper run and lower run, down-stream of the stock-receiving end, and underlie and support the upper run at intervals in a dewatering zone. The movable foil means comprise at least one foil member mounted for limited independent movement in the cross direction of the machine and having a top surface in sliding frictional contact with the forming fabric and means for vibrating the foil in the cross machine direction.

When the Fourdrinier section has a plurality of foils, as it usually does, means can be provided for vibrating some, while others remain stationary.

If required, at least a portion of the fabric contacting part of the surface of a shaking foil may be of a material having a relatively high coefficient of friction for example, soft rubber, The greater resistance thus enhances the transmission of the oscillating motion from the foil to the fabric.

In a preferred embodiment of the invention, the frequency of the vibratory motion of the fiol or foils is substantially equal to the natural resonant frequency of transverse vibration of the fabric in its own plane while in operation with the stock on it, or an harmonic thereof. Due to some friction between the foil or foils and the fabric in the lateral direction, the fabric will be caused to vibrate in resonance.

It is known that the natural frequency of vibration of a tight string is given by the formual:

$$F = (K/2L)\sqrt{T/M}$$

where $F$ = natural frequency of vibration (Hz)
$K$ = an integer depending on the harmonic number
$L$ = length of the string (meters)
$T$ = tension of string (Newtons) and
$M$ = mass of the string (Kg)

Thus the frequency of vibration increases as the string is shortened, as the string is tightened and as the mass per unit length is decreased. If the string vibrates as a whole it is in its fundamental (natural) mode of vibration and $K = 1$. Under some conditions the string can be made to vibrate at an harmonic frequency, in which case one or more nodal points occur along the length of the string where there is no transverse vibration. In these cases $K = 2, 3$, etc. (for the second, third, etc. harmonic). If the string vibrates in the second or higher harmonic mode, the frequency is accordingly higher.

It has been found that a Fourdrinier forming fabric will also vibrate transversely to its length and in its own plane when tensioned to paper machine tension. It has also been found that if T, L and M, in the above formula are replaced with $T_f$, $L_f$ and $M_f$, where $T_f$ is tension in the fabric in Newtons per meter of width, $L_f$ is the length of the fabric affected in meters, and $M_f$ is the mass per unit length of a 1 meter wide strip of and stock, in order words the mass per square meter, then the natural resonant frequency of the upper run can be calculated approximately by the formula.

$$F = (K/2L_f)\sqrt{T_f/M_f}$$

Thus a resonant type of shaking action can be induced in the upper run of a Fourdrinier fabric by making the foil or foils move in a transverse direction across the underside of the upper run by sliging them with a vibratory motion with a calculated frequency at or near the natural resonant frequency of the upper run. More than one foil could be made movable to obtain this result.

The frequency of the vibratory motion of said foil may be an harmonic of the natural frequency of said upper run. When the frequency is an harmonic, then the number of vibrating foils is preferably at least equal to the harmonic number, and each vibrating foil, or set of vibrating foils, in each harmonic is located within a loop formed in the upper run when it is in vibratory motion. Adjacent individual foils, or sets of foils, which are movable will vibrate 180° out of phase with each other.

BRIEF DESCRIPTION OF THE DRAWINGS

The invention will be better understood by an examination of the following description together with the accompanying drawings which illustrate preferred embodiments, and in which.

DETAILED DESCRIPTION OF THE DRAWINGS

Figure 1:
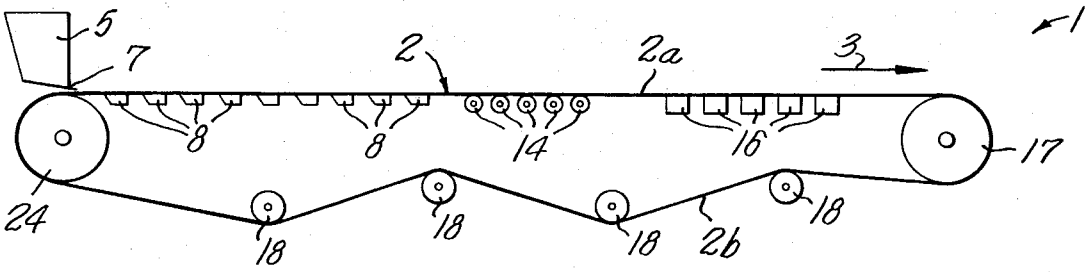
Prior art FIG. 1
FIG. 1 is a side view of a Fourdrinier section of a paper making machine as well known in the art.

Referring to FIG. 1, the Fourdrinier section, indicated generally at 1, comprises an endless fabric 2, having an upper run 2*a* and a lower run 2*b*. The fabric runs in the machine directon shown by the arrow 3, and stock is fed to the upper run at the wet end thereof from a headbox 5 and a slice 27. The endless belt passes over breast roll 24, dewatering devices comprising foils 8, table rolls 14 and suction boxes 16. It passes over couch drive roll 17, return rolls 18 and so back to the breast roll. The belt is driven by the couch drive roll.

As is well known, Fourdrinier fabrics are operated in a range of tension of between about 10 lb/in. (1752 N/M) and about 40 lb/in. (7000 N/M) in the region where the paper is formed, i.e., in the upper run at the wet end. It is also known that the stock diminishes in height, as it progresses down the Fourdrinier machine and water is removed, from a maximum of about 3 inches in the case of heavy weight kraft paper ($\frac{1}{4}$ inch for light weight grades of paper) at the feed end, to a thickness generally less than $\frac{1}{8}$ inch by the time the stock reaches the suction boxes. Thus the mass of stock on top of the fabric is variable with different grades and diminishes along the length of the fabric.

Figure 2:
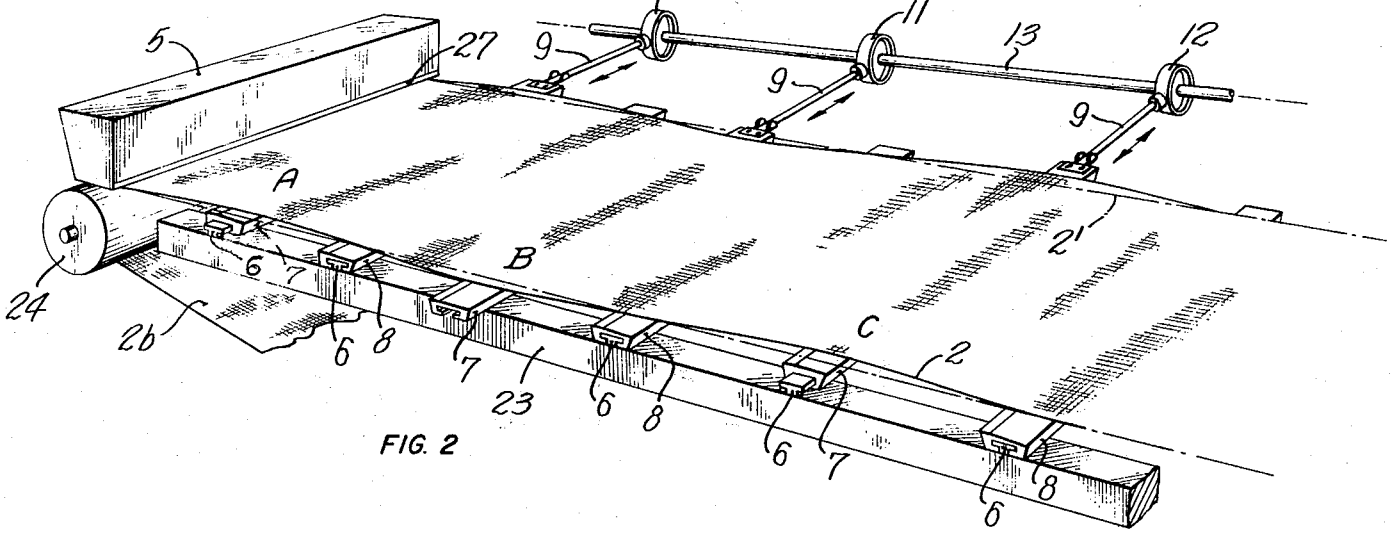
FIG. 2 is a perspective view of the wet end of a Fourdrinier section of a paper making machine according to the present invention.

The apparatus in accordane with the invention is illustrated in FIG. 2. In this figure the side frame 23 carries a plurality of fixed T-bars 6. Foils 7 are mounted on the T-bars 6 for movement relative to the T-bars while foils 8 are fixed on their respective T-bars 6. Foils and associated T-bars, of this type are described and illustrated in U.S. Pat. No. 3,337,394, White et al, or, U.S. Pat. No. 3,446,702, Buchanan. Generally speaking, a foil consists of a relatively thin, narrow blade of durable plastic material, such as high density polyethylene, which is mounted in sliding engagement on a T-shaped support member, commonly referred to as a T-bar. The top or fabric engaging part of the foil will have a leading edge, a supporting surface, a divergent foiling surface and a trailing edge. As can be seen in the drawings herein and in the above patents, the supporting surface comprises a continuous, uninterrupted flat portion of the top surface of the foil and extends over the entire length of the foil. The total width of a foil blade, in the machine direction, will be in the order of $4\frac{3}{4}$ inches (12 cms). The depth of the blade from the support surface to the bottom side of T-bar engaging lugs will be in the order of $1\frac{1}{4}$ inches (3 cms) or less, and the length of the blade, extending across the paper machine will be a few inches in excess of the operating width of the machine. By this description a single foil blade for a high speed paper machine of average width would weigh less than 50 lbs. (23 Kg.). In the case of a vibrating foil blade, the tolerances for sliding engagement with the T-bar support are eased to provide good retention of angularity with the least possible resistance to sliding.

Although three movable foils are shown in FIG. 2, this is for the purpose of illustrating the invention only. It will be quite clear to one skilled in the art that a single movable foil could be used in implementing the invention. Alternatively, more than three movable foils could be employed. A criteria for selecting the number of movable foils is briefy discussed below.

In the embodiment shown in FIG. 2, three of the foils are shown mounted for movement of the T-bars 6. This will produce three loops, A, B and C when the frequency of vibration of the foils is equal to the third harmonic of the resonant frequency of the upper run.

The foils 7, which are in sliding engagement with the T-bars 6 are shown as being connected by rods 9 to eccentrics 10, 11 and 12, which are in turn mounted on a shaft 13. As the eccentrics rotate, their eccentricity is transmitted to the foils by the connecting rods, and the foils slide from side to side along the T-bars. The successive eccentrics are preferably set at 180° to each other, and the motion of each eccentric is set to excite the fabric so that it oscillates laterally about the fixed foils 8 located at the nodal points. Thus, adjacent ones of the movable foils will move in opposite directions due to the actions of the eccentrics.

Figure 3:
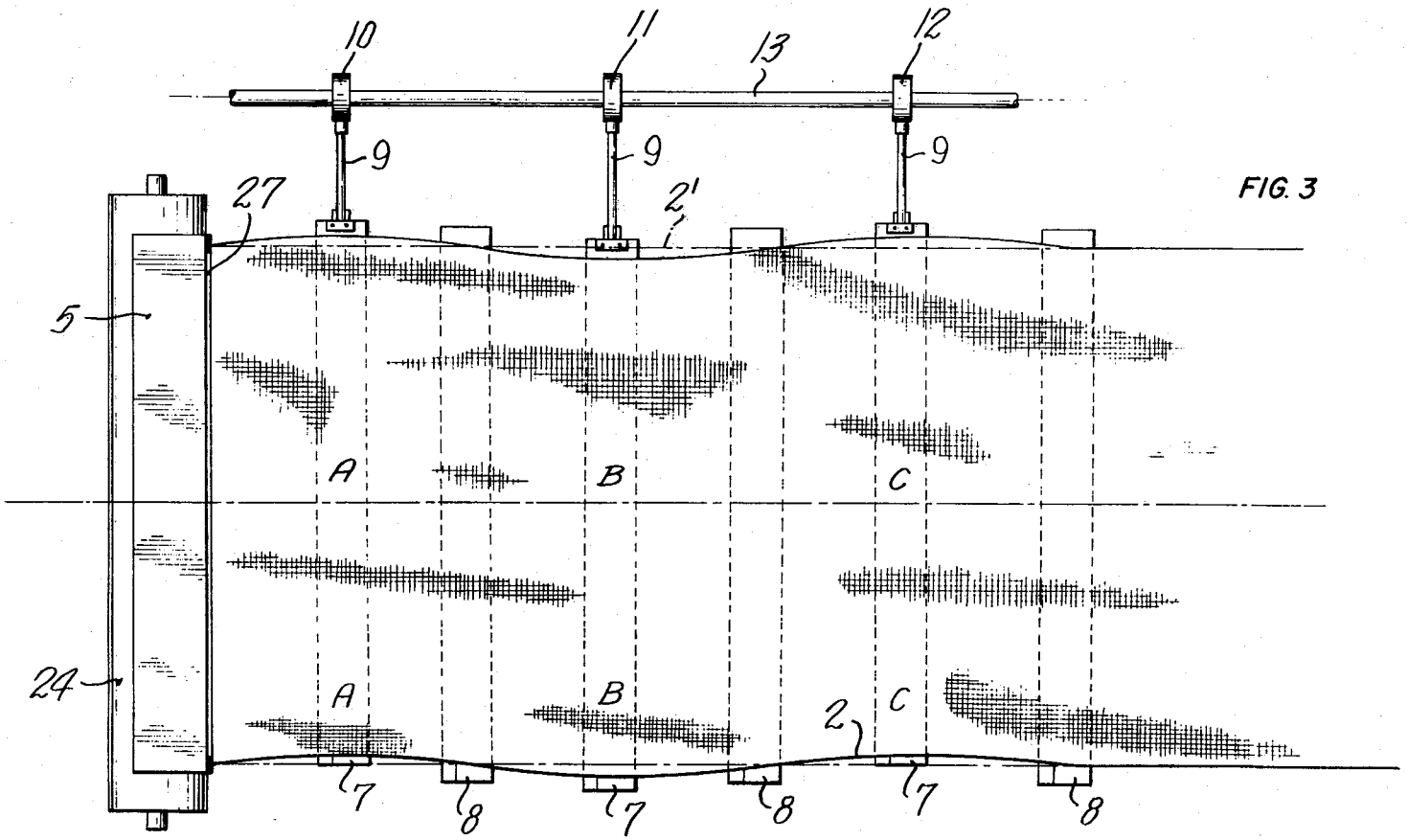
FIG. 3 is a top view of FIG. 2.

In FIGS. 2 and 3, the solid line 2 represents, with great exaggeration, the position of the upper run while in motion as compared to the dotted line 2' which represents the normal straight position of the upper run. As can be seen, each of the movable foils is located in a loop, i.e., between two fixed points of the upper run.

As will be appreciated, it is possible to have more than one foil vibrating at the fundamental frequency of the upper run, however, in such a case, the foils will be vibrated in unison, i.e., they will move back and forth at the same time. In this case, the eccentrics will all be in phase with each other rather than being phase shifted by 180° as shown in FIGS. 2 and 3. In cases where foils move in unison the amplitude of vibration can be adjusted to comply with the amplitude required by their position in the vibrating set. For example, from a maximum near the center of a loop, the amplitude of vibratory motion will become decreasingly smaller towards the nodal points.

It will also be appreciated that it is possible to have other stationary or oscillating foils as well as other dewatering devices in the wet end section that are independent of the vibratory system.

The oscillating foils 7 are composed of high density polyethylene or some similar material that has a low coefficient of friction with the T-bar material. Thus a freely sliding fit can be provided without excessive clearance that would adversely influence foiling action. To improve adherance of the foil with the fabric in the cross-machine direction so that oscillation of the foil may be transmitted to the fabric, the surface of the foil which contacts the fabric may be provided with an insert of a material such as soft rubber which will have a high friction coefficient with the surface of the fabric but will not wear the fabric or impede it unduly.

Although one mechanical method of oscillating the foils is shown in the drawings and described, the invention is not limited to this. A hydraulic or pneumatic or any other type of oscillating device may be used providing it is adequate for the requirements of the vibratory system.

In a laboratory experiment, the resonant frequency of a running Fourdrinier fabric loaded with simulated stock, having the following properties was measured:

$L = 2.46$ mters
$T = 2{,}000$ N/M
$M = 0.3$ Kg/sq.m.

The fabric was subjected to vibratory motion of about 5 mm. by three foils oscillating in unison transversely to its length through a range of frequency and it was found to resonate at about 15 Hz which is close to the theoretical value for the fundamental frequency given for the above formula. ($F = 16.6$ Hz).

On an operating Fourdrinier machine, the invention is carried into practice in its preferred mode by selecting a number of foils at special locations along the length of the table and vibrating all of these with a common frequency. In some cases, the fabric will be caused to oscillate in the fundamental mode of vibration in which case the entire fabric from the breast roll to the suction boxes will oscillate with a maximum amplitude reached part way between the breast roll and the flat boxes. Where the forming section of the machine is long, or where it is desired to have a higher frequency of oscillation, it may be desirable to excite the second harmonic frequency of vibration of the fabric, in which case a nodal point will be caused to occur part way down the fabric. The fabric will then have a maximum amplitude at two points between the breast roll and the suction boxes. Because the mass of stock and fabric changes along the length of the Fourdrinier fabric, the length of these nodal loops will not be the same but will be shorter at the wet end than at the dry end. In other cases, the third harmonic or higher harmonic may be induced depending on the needs of the machine. In practice, it is desirable to shake the stock transversely about 10 times before it is finally set but this varies with grades and speeds. With the use of the formula given above and the principle of this invention, a person skilled in the art can find the arrangement most suited to his requirements.

It has been discovered through out testing that transverse oscillations can be induced in a Fourdrinier fabric by the transverse oscillations of foil blades in normal contact with the fabric. Thus rapid vibratory motion can be provided to shake the stock on the wet end of large, high speed paper machines by the action of only a few very light-weight foil blades. An unexpected result of our testing, which is important to this invention, is that a fabric can be excited in its trasverse mode of natural vibration even though it is overlaid with a fibrous mat. Thus, with a minimum of energy a high degree of stock shake may be obtained regardless of the size of the paper machine.

The advantages and benefits of the instant invention is that, a Fourdrinier section with the improvements of the invention will provide better paper formation with high speed machines. In addition, the formation is more uniform because the shake motion is more precise than agitation produced by stock kick-up which occurs on ordinary Fourdrinier machines and which is more critically dependent on many variables such as foil wear, foil spacing, fabric tension, mat resistance, stock freeness, stock temperature, etc. Further, with this invention, it is possible to use devices having very low suction in the beginning part of the table which has heretofor not been permissable in view of the need for agitating the fibres at the beginning of the table by devices providing higher suction.

In general, when the upper run is vibrated at an harmonic of its natural frequency, then the number of foils must be at least equal to the harmonic number. If the harmonic number is, for example, two, then the foils will be divided in two sets and each set will be disposed in a loop formed in the fabric when the fabric vibrates. Adjacent sets will be moved at 180° phase relationship to each other. If the integral number is, for example, three, then the foils will be divided into three sets and all further criteria as above will also be observed.

Although the preferred method is to oscillate the foils at or near the resonant frequency of the fabric, the invention is not limited by this condition. In some cases where heavy weights of stock are used, or other conditions, no sharp resonant frequency can be discerned and in these cases more latitude in the frequency chosen can be used and the invention of shaking the fabric by oscillating foils is still useful.

As mentioned above, it is also possible to have more than one movable foil even when the upper run is being vibrated at its natural resonant frequency. In such a case, all of the foils will be vibrated in unison, and it is preferable that the foils be disposed within the loop formed when the upper run is vibrated. As can be seen, because only light-weight foils are being used, it is possible to vibrate these foils at the high frequencies required by high speed machines whereby to cause vibration of the upper run at these required frequencies. Although in the drawings the foils have been shown mounted on T-bars, it will be clear that other mounting means could be used over which mounting means the foils would also be movable. It is only necessary that at least one foil be made to be movable in a direction transverse to the machine direction whereby vibratory motion of the foil or foils will impart a vibratory motion to the upper run of the Fourdrinier section.

Several embodiments have been described above and this was for the purpose of illustrating, but not limiting the invention. Various modifications which will come readily to the mind of one skilled in the art are within the scope of the invention.

I claim:

1. Shaking means for use on a paper making apparatus which includes an endless belt-like forming fabric driven in a machine direction by a drive roll, said fabric having an upper stock carrying run having a natural frequency of lateral vibration and a lower run between the drive roll and a driven roll and including dewatering foils, disposed between the upper run and lower run, underlying and supporting the upper run at intervals in a dewatering zone, said shaking means for vibrating the upper run of the fabric including movable foil means, said shaking means comprising one or more elongated foil members disposed in a substantially horizontal attitude for engagement transversely on the under surface of the upper run downstream of a stock feed end in the dewatering zone, said foil members being mounted for limited independent movement in a cross machine direction while engaging the under surface of the said upper run and said foil members having a continuous, uninterrupted top flat fabric supporting surface over the entire length thereof in frictional contact in the cross machine direction with the said under surface of the fabric; and means for vibrating said movable foil members transversely of the said upper run at a frequency harmonically related to a frequency substantially equal to the said natural frequency of the upper run of the fabric and stock whereby the foil members have the dual function of dewatering and inducing resonating harmonic vibrations in the upper run to uniformly produce an improved quality of paper.

2. Shaking means, as defined in claim 1, in which said movable foil means comprises a plurality of foil members.

3. Shaking means, as defined in claim 2, wherein said dewatering foils includes at least one stationary foil member.

4. Shaking means, as defined in claim 1, wherein part of said flat top surface portion of said movable foil member comprises a rubber-like material.

5. Shaking means, as defined in claim 1, wherein each movable foil member is slidably mounted on a T-bar disposed in the cross machine direction.

6. Shaking means, as defined in claim 5 wherein said means for vibrating said foil member is connected to one end of said foil.

7. Shaking means, as defined in claim 3 wherein each movable foil member is slidably mounted on a separate T-bar disposed in the cross machine direction.

8. Shaking means, as defined in claim 3, wherein said shaking means comprises means for vibrating each of said movable foil means 180° out of phase with each adjacent movable foil means.

9. Shaking means as defined in claim 2 wherein the harmonically related frequency is an integral number multiple of the natural frequency, and the number of movable foils is at least equal to the integral number.

10. The method of producing paper and ensuring a uniform repetitive quality of the paper comprising the steps of:

providing a paper making machine with a Fourdrinier section having an endless forming fabric belt which has an upper stock carrying run having a natural frequency of lateral vibration;

depositing paper stock on the upper run of the endless belt;

determining the natural frequency of the upper stock carrying run of the endless fabric belt;

driving the endless belt in the machine direction while depositing wet paper making stock at the upstream end of the fabric;

providing at least one foil member, having a continuous, uninterrupted, flat top supporting surface portion over the entire length thereof, and disposing the foil member such that the top surface portion is in frictional engagement with the under surface of the upper run of the endless fabric belt;

applying a lateral force on the under surface of the upper run of the endless fabric belt by vibrating the foil member in a cross machine direction to thereby cause the upper run of said endless fabric belt to vibrate uniformly;

characterized in that the foil member is vibrated at a frequency harmonically related to a frequency substantially equal to the said natural frequency of the stock carrying upper run of the belt.

11. Shaking means for vibrating a stock carrying run of an endless belt-like forming fabric of a paper making apparatus, said stock carrying run having a natural frequency of lateral vibration;

said shaking means comprising:

one or more elongated movable dewatering foil members underlying and supporting the stock carrying run at intervals in a dewatering zone, each having a continuous, uninterrupted, flat top fabric supporting surface over the entire length thereof; and means for vibrating each of said foil members independently of the other foil members and transversely of said stock carrying run, at about a frequency harmonically related to said natural frequency of said stock-carrying run;

said movable foil members being disposed in transverse engagement on the undersurface of said stock carrying run in the dewatering zone;

whereby the foil members have a dual function of dewatering and inducing resonating harmonic vibrations in the stock carrying run to produce paper having uniform formation.

12. Shaking means as defined in claim 11 and further including one or more stationary dewatering devices, said stationary dewatering devices being disposed between adjacent ones of said movable foil members.

13. Shaking means as defined in claim 12 wherein at least part of said flat top fabric supporting surface of said movable foil members comprises a rubber-like material.

14. Shaking means as defined in claim 13 wherein said rubber-like material comprises an insert insertable into said flat top surface.

15. Shaking means as defined in claim 11 wherein each movable foil member is slidably mounted on a T-bar disposed transversely of said stock-carrying run.

16. Shaking means as defined in claim 15 wherein said means for vibrating said movable foil members is connected to one end of each of said movable foil members.

17. Shaking means as defined in claim 15 comprising means for vibrating each of said movable foil means 180° out of phase with each adjacent movable foil means.

18. Shaking means as defined in claim 11 wherein the harmonically related frequency is an integral number multiple of the natural frequency, and the number of movable foils is at least equal to the integral number.

19. A method of producing paper having uniform formation on a paper making machine comprising a forming section having an endless fabric forming belt which has a stock-carrying run having a natural frequency of lateral vibration, comprising the steps of:

depositing paper stock on the stock-carrying run of the endless belt, and determining the said natural frequency thereof;

driving the endless belt in the machine direction while depositing wet paper making stock at the upstream end of the endless belt;

providing at least one foil member, having a continuous, uninterrupted, flat top fabric supporting surface portion over the entire length thereof, and disposing the foil member such that the top surface portion is in frictional engagement with the undersurface of the stock-carrying run of the endless fabric belt;

applying a lateral reciprocal vibratory force on the undersurface of the stock-carrying run of the endless fabric belt by vibrating the said foil member in the cross machine direction to thereby cause the stock-carrying run of said endless fabric belt to vibrate uniformly;

characterized in that the foil member is vibrated at about a frequency harmonically related with said natural frequency of the stock-carrying run of the belt.

* * * * *